United States Patent [19]

Stanfield

[11] 4,207,005

[45] Jun. 10, 1980

[54] PRONGED VIBRATOR

[76] Inventor: Charles E. Stanfield, P.O. Box 465, Maple Valley, Wash. 98038

[21] Appl. No.: 830,120

[22] Filed: Sep. 2, 1977

[51] Int. Cl.[2] ..... B01F 11/00

[52] U.S. Cl. ..... 366/108; 366/123; 366/128; 222/196

[58] Field of Search ..... 366/108, 117, 120, 122, 366/123, 128, 118, 112, 113, 114; 248/17, 18; 222/196

[56] References Cited

U.S. PATENT DOCUMENTS

| | | | |
|---|---|---|---|
| Re. 26,748 | 12/1969 | Schempf | 366/108 |
| 2,174,348 | 9/1939 | Damond | 222/196 |
| 2,620,970 | 12/1952 | Palmer | 248/18 |
| 3,166,222 | 1/1965 | Schrader | 366/108 |
| 3,724,819 | 4/1973 | Varnum | 366/128 |

FOREIGN PATENT DOCUMENTS

| | | | |
|---|---|---|---|
| 2016204 | 10/1971 | Fed. Rep. of Germany | 222/196 |

*Primary Examiner*—Robert W. Jenkins

*Attorney, Agent, or Firm*—Roy E. Mattern; Kenneth S. Kessler

[57] ABSTRACT

A vibrator with attached prongs which achieves the breakup of compacted materials in structures similar to silos, grain elevators and railroad cars is set forth. Attached to the pronged vibrator is a cable which allows the vibrator to be lowered into the structure where breakup is to be accomplished. The vibrator is housed within a shell of dimensions applicable to the particular use. Secured to the vibrator shell are a multiple of prongs. The vibrator when in operation causes not only the sphere to vibrate, but also the attached prongs. The vibrator is capable of imparting varying frequencies to the compacted materials and may be adjusted to reach the natural frequency of the compacted material. Thus where the vibrator comes into contact with the compacted material, breakup is achieved both by the physical action of the prongs and also by achieving the natural frequency of the material which in and of itself causes breakup.

20 Claims, 10 Drawing Figures

PRONGED VIBRATOR

BACKGROUND OF THE INVENTION

Different groups of materials and farm products are stored in silos, grain elevators and similar structures. After a period of time due to pressure, heat and other factors, the materials often compact and congeal against the side walls. This compacting can prevent the flow of material through the structure in addition to preventing the use of the compacted material itself.

In the past, several ineffective and dangerous methods have been used to breakup the materials. One method has been to physically lower a man into the structure. Such action has resulted in injuries and fatalities due to the caving in of materials, fumes from the materials and suffocation. Another method used has been to vibrate portions of the structure itself to break the compacted material away from the wall. This method is often ineffective and can cause structural damage to the subject structure.

Several vibrating systems have been patented which achieve the compacting of materials such as concrete: Ludeman U.S. Pat. No. 2,080,727; Spaulding U.S. Pat. No. 3,020,720; and Malan U.S. Pat. No. 3,836,124. The present system, however, is designed for the opposite result: the breakup of compacted material, and thus using prongs capable of breaking the compacted material.

U.S. Pat. No. 3,710,964 discloses a method of feeding materials in a storage bin. A vertical shaft is suspended from the top of the bin. Blades are attached to the shaft along with a vibrating mechanism. The blades are capable of vibration and when placed over or near the discharge opening, can prevent the arching of material over the discharge opening.

The vibrator disclosed herein, since it is introduced into the structure by cable, is more versatile than a stationary blade. The disclosed vibrator may be utilized to break up materials stuck to walls, to the bottom of the bin, arching over the discharge opening, or materials in any other position in the storage bin. In addition the system disclosed can be introduced into the bin after the materials have been compacted for the vibrator can breakup already compacted materials. Thus, the system need not be housed in each bin and one vibrator may be used for many structures as opposed to the fixed blade set forth in U.S. Pat. No. 3,710,964.

The disclosed vibrator also takes advantage of the fact that every material has a natural frequency at which it will "dance" and move on its own. The vibrator may achieve the varying frequencies of the various materials by making the following adjustments: varying the length of the prongs; adjusting the position of the eccentrics; and adjusting the number of the revolutions per minute of the eccentrics. Once the natural frequency is achieved, the materials themselves breakup, and with the proper positioning of the vibrator, the material may be effectively moved to the desired position.

The versatility of the described vibrator also allows two or more vibrators to be introduced into the storage bin. When both vibrators reach the material's frequency, the material experiences a rippling effect and is even more effectively broken up.

SUMMARY OF THE INVENTION

Due to pressure, heat and other factors, certain materials stored in silos, grain elevators and similar structures often compact preventing flow when the structures are to be emptied. To effect the breakup of these compacted materials, a cable is connected to a pronged vibrator which is lowered into storage bins or similar structures to breakup the compacted material.

Materials which are stored in storage facilities have individual frequencies which, when the natural frequency is reached, cause the individual particles to move. The pronged vibrator disclosed herein is designed to cause the individual materials to achieve these various individual frequencies. The pronged vibrator may achieve specific frequencies and amplitudes by making certain combinations of the following adjustments: varying the length of the prongs; adjusting the position of the eccentrics; and adjusting the revolution per minute of the eccentrics.

The prongs may be affixed to any configuration capable of vibration. However, the use of a spherical shell for the reception of the prongs and housing of the vibrator is advantageous for this configuration is equally effective irregardless of what position the spherical pronged vibrator comes into contact with the compacted material.

A multiple of prongs are attached to the outer spherical shell. The prongs are easily removed from the sphere, thereby allowing the operator to easily adjust the length of the prongs.

The pronged vibrator effectively breaks up compacted material by both chewing into the material with the extruded prongs and by using the prongs to cause the material itself to reach its natural frequency and, therefore, aid in the breakup and movement of the material.

The vibrator may be powered electrically, pneumatically or hydraulically. The motor rotates the eccentrics which may be adjusted in order to attain a given number of rotations per minute. The motor also has the capability of changing the direction of the eccentric's rotation.

The eccentric shaft upon which both eccentrics are attached, has indentations on one end of the shaft which allows the eccentrics to be placed in different relative positions to each other thereby providing for the third adjustment wherein the operator may achieve the desired frequency and amplitude in the compacted materials.

The pronged vibrator may be used singly or may be used in combination. When two pronged vibrators reach the compacted material's frequency, the compacted material experiences a rippling effect and is even more effectively broken up than when one pronged vibrator is utilized.

DETAILED DESCRIPTION OF THE DRAWINGS

Figure 1:
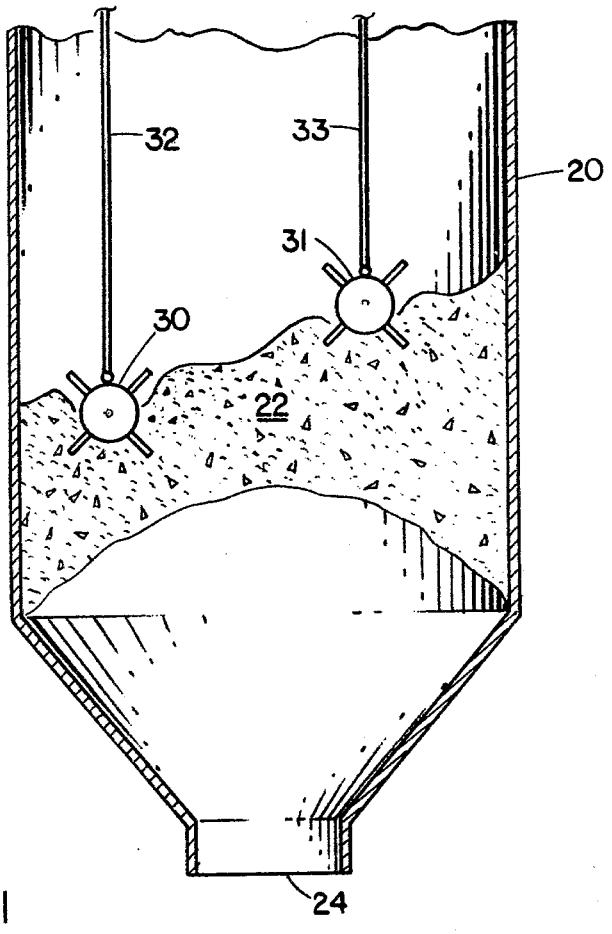
FIG. 1 is a schematic view of two vibrators lowered into a bin with compacted material bridged over the bin's exit.

FIG. 1 depicts a storage bin 20 with compacted material 22 arching over the storage bin exit 24 preventing the flow of compacted material 22 through the storage bin 20. Two pronged vibrators 30 and 31 have been lowered into the bin to break up the compacted material 22. Although the compacted material 22 is illustrated as compacted in an arch over the storage bin exit 24, it is to be understood that the pronged vibrator is equally effective in breaking up compacted materials in various locations within the storage bin 20.

The pronged vibrators 30 and 31 are lowered into the storage bin 20 until the spheres 30 and 31 come into contact with the compacted material 22. The pronged vibrators 30 and 31 are lowered by cables 32 and 33. The lowering of the pronged vibrator 30 by a cable 32 gives the pronged vibrator versatility. Thus, the pronged vibrator may be used in a multiple of different storage bins thereby precluding the necessity of a pronged vibrator being mounted permanently in each storage bin.

Figure 2A:
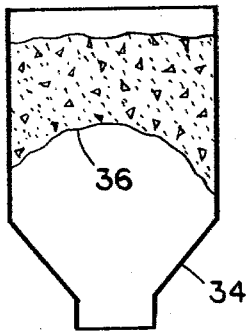
FIG. 2 is a schematic view of examples of the common positioning of compacted materials within storage bins known in the trade as follows: (a) arching; (b) ratholing; and (c) side pockets.
Figure 2B:
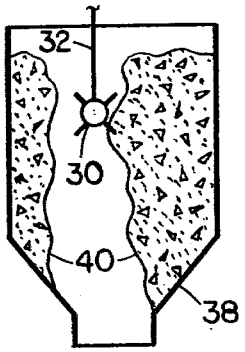

In FIG. 2, the common positionings of compacted materials within storage bins is illustrated. In FIG. 2*a*, bin 34 is shown with compacted material 36 arching from sides of the bin 34. The pronged vibrator may be introduced from the top of the bin 34 to eat its way through the compacted material 36 thereby causing the material to either drop to the bottom of the bin or at least form a hole from which the vibrator may continue to break up compacted material.

FIG. 26 illustrates compaction 40 in bin 38 known as "ratholing". The pronged vibrator 30 is introduced into the hole which runs from the top of the bin 38 to the bottom of the bin. Since the vibrator is extended by a cable 32, the vibrator may be worked up and down the "rathole", causing the sides of the compacted material to break up and drop to the bottom of the bin.

Figure 2C:
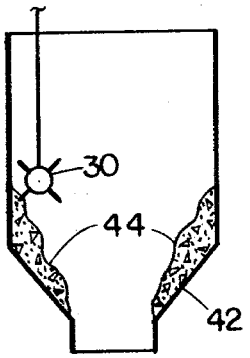

A final positioning of compacted material 44 is illustrated in FIG. 2*c*. The compacted material is positioned against opposing sides of the bin 42. Since lowering the pronged vibrator 30 by cable allows for versatility in direction, the pronged vibrator may come into contact with one side of the compacted material 44 and later work on the break up of the opposing side's compacted material.

Figure 3:
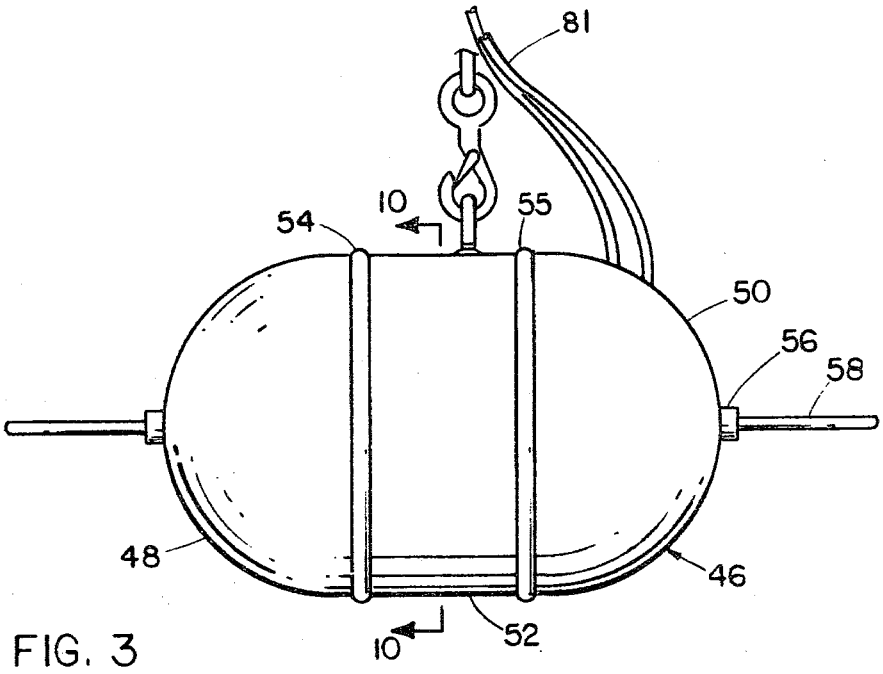
FIG. 3 is a schematic view of the outer sphere of the vibrator in the preferred embodiment and the pronged sphere vibrator.

The pronged vibrator 30 may assume any configuration which allows the vibrator to be placed within or upon a structure and coming into contact with compacted material. Thus, the pronged vibrator may take the shape of a cube, rectange, triangle, rectangular sheet or any other configuration. In the preferred embodiment, as illustrated in FIG. 3, the vibrator assumes a spherical shape. The spherical shape of the pronged sphere vibrator 46 is advantageous for it is effective irregardless of what position the spherical pronged vibrator 46 comes into contact with the compacted materials. The spherical shape also allows efficient use of the pronged sphere vibrator 46 when smothered with compacted material. The weight and extent of the compacted material when the vibrator is working within the depths of a bin can be extreme. In the spherical configuration exhibited in the preferred embodiment, the weight of smothering material tends to move over the shell rather than weighing directly on the top of the vibrator thereby potentially breaking the suspending cable 32 or stopping operating by the material's weight.

As illustrated in FIG. 3, the outer circumference of the pronged sphere vibrator 46 is composed of two separate half spheres 48 and 50. The two separate half spheres 48 and 50 are in the shape of two domes. The separate half spheres 48 and 50 attach to cylindrical outer shell 52 and flanges 53 and 55 thereby composing the outer circumference of the pronged sphere vibrator 46. In the preferred embodiment, the half spheres 48 and 50 are easily removed in order for ease in repair and maintenance of the vibrator mechanism.

As illustrated in FIG. 3, attached to the outer half spheres 48 and 50 of the pronged sphere vibrator 46 are prongs 58. In the preferred embodiment, the prongs screw into fittings 56 affixed to the pronged sphere vibrator.

Figure 6:
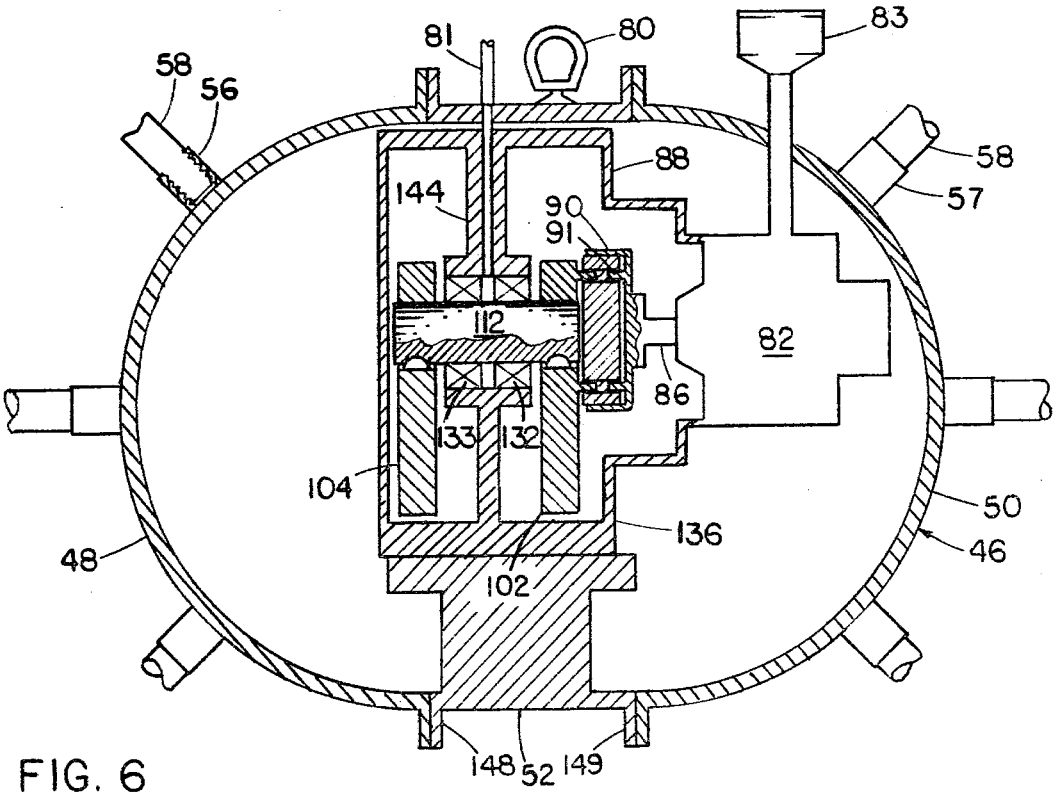
FIG. 6 is a sectional side view of the pronged sphere outer shell and shows a cutaway view of the vibrator mechanism. The attached prongs are not shown in this view.
Figure 7:
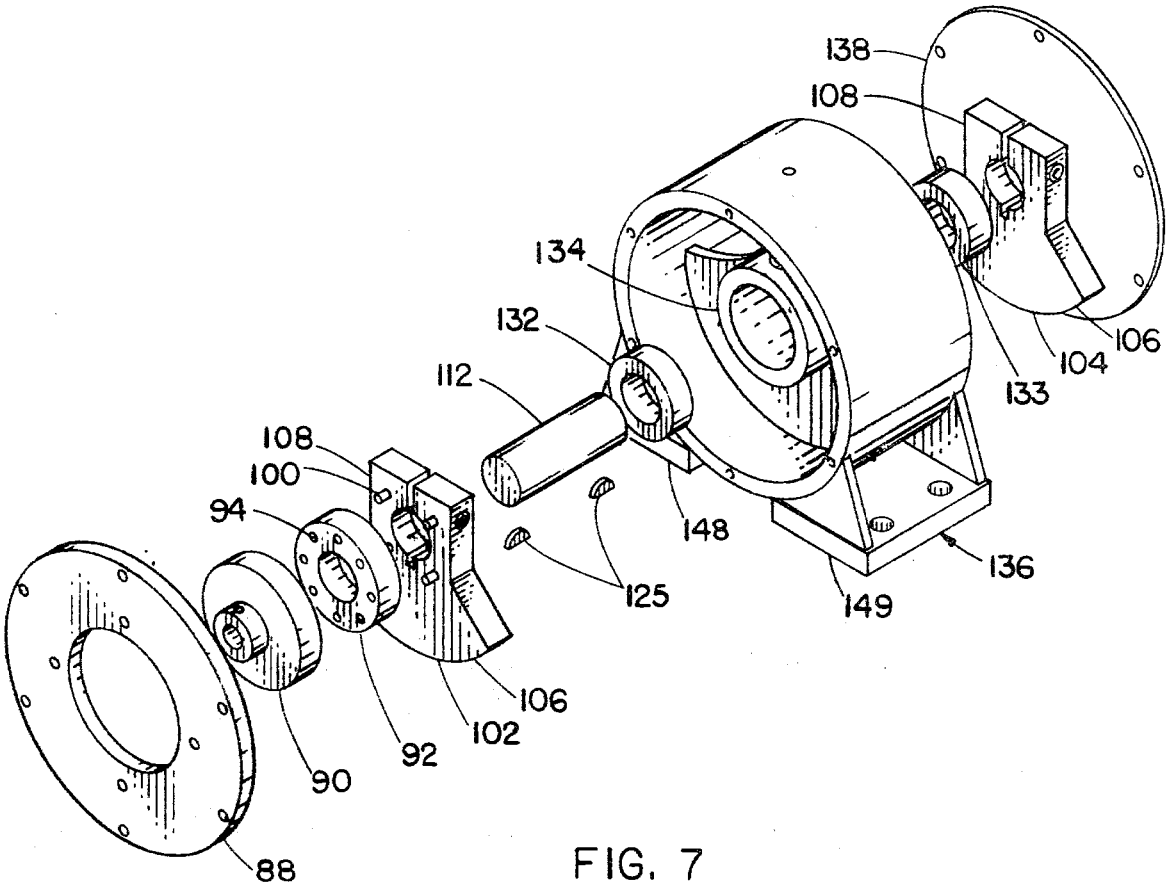
FIG. 7 is a perspective view of the detached component parts of the vibrator.

In the preferred embodiment the fittings 56 are placed about the spherical vibrator 46 in order to make each fitting 56 equidistant in relation to the other fittings 56. Equidistance between the fittings is not absolutely necessary but does aid in the controlled imparting of frequencies to the compacted materials. In the preferred embodiment as illustrated in FIG. 6 fitting 57 which is near the exhaust 83 is displaced by a small amount to allow room for exhaust 83.

By providing for the easy removal of the prongs 58, the prongs may be removed when lowering the pronged sphere vibrator 46 through a small opening and then the prongs 58 may be re-fit on the pronged sphere vibrator 46 after passing through the small opening. In addition, the easy replacement of different length prongs 58 aids in the ability of the pronged sphere vibrator 46 to impart different frequencies to the various compacted materials.

Compacted materials all have their own individual natural frequencies. When a material reaches its natural frequency the material begins to move and "dance", thus aiding the breakup of the material if it is compacted.

As an example, materials such as sugar and pumice have high natural frequencies whereas wood flakes have a lower frequency and amplitude. The length of prongs 58 is one of the three following adjustments that can be made on the pronged sphere vibrator 46 in order to impart the desired frequency to the material: length of the prongs 58; the relative position of eccentrics 102 and 104 between themselves; and the adjustment of the revolutions per minute of the eccentrics 102 and 104. Longer prongs 58 are affixed to the pronged sphere vibrator 46 when the material has a flake or loose quality, whereas shorter prongs 58 are affixed when the material is more granular.

The prongs 58 not only aid in imparting frequency but are also capable of piercing the physically breaking up the compacted material.

The pronged sphere vibrator 46 is lowered into the bins by cable 32. To prevent the cable 32 and operator from receiving the vibrational energy transmitted by the pronged sphere by the pronged sphere vibrator 46 an isolator 60 is positioned between the pronged sphere vibrator 46 and the operator.

Figure 4:
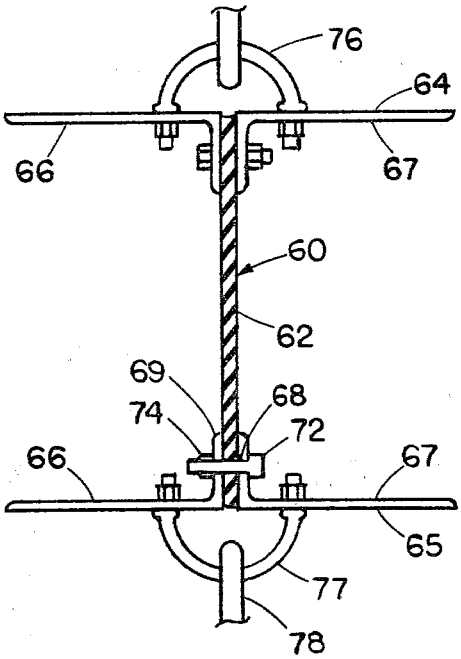
FIG. 4 is a side view of the isolator as attached to the suspending cable and the pronged sphere vibrator.
Figure 5:
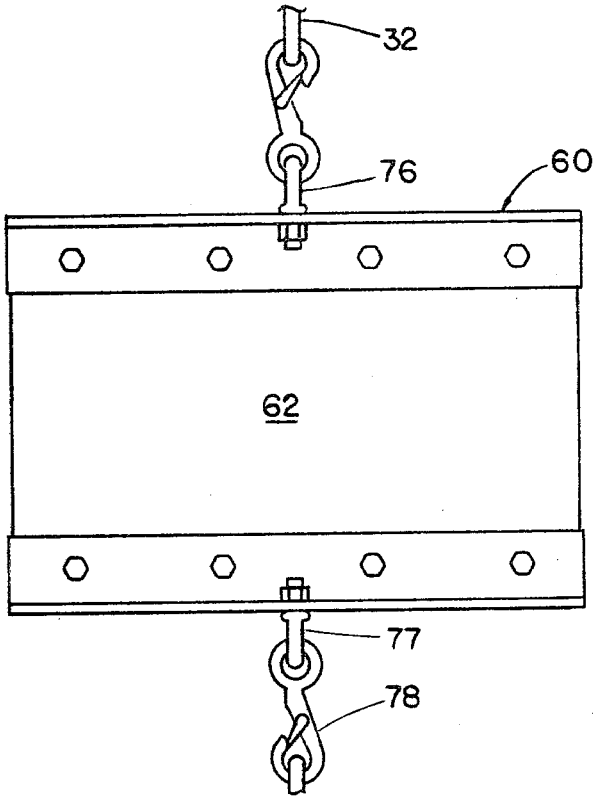
FIG. 5 is a front view of the isolator as attached to the suspending cable and both the pronged sphere vibrator.

In the preferred embodiment shown in FIG. 4 the isolator 60 is composed of thick industrial rubber belting 62 secured at either end by "T shaped" securing plates 64 and 65. "T shaped" securing plates 64 and 65 are composed of "L shaped" plates 66 and 67. Corresponding holes 68 are placed in the protruding portions 69 of the "L shaped" plates. The industrial belting 62 also has corresponding holes which allow bolts 72 and nuts 74 to draw the protruding portions 69 of the "T shaped" securing plates 64 and 65 together thereby holding the industrial belting 62 secure.

Attached to the top of the "T shaped" plates 64 and 65 are eye hooks 76 and 77. The cable 32 attaches to eye hook 76 and eye hook 77 attaches to hook 78. Hook 78 in turn is secured to swivel eye 80 which is attached to the cylindrical outer shell 52 of the pronged sphere vibrator 46. The cable 32, in conjunction with the swivel eye 80 may be operated manually or automatically to achieve the desired direction and location of the pronged sphere vibrator 46.

Lines 81, in FIG. 3, run down cable 32 and through half sphere 50 to the vibrator mechanism 84. Lines 81 are capable of several uses, ie., pneumatic, exhaust, etc., depending on the type of motor being employed. Also, the number of lines and their position may be altered to meet each situation. For instance, in FIG. 6, the preferred embodiment a line is used to grease ball bearings 132 and 133.

The motor 82 and vibration mechanism 84 are positioned in relation to each other and the outer circumference of the pronged vibrator 46 in order to provide balance. Thus, when the pronged sphere vibrator 46 is suspended by cable 32, through swivel eye 80, the pronged sphere vibrator will stay in suspension and will not lean in one direction or the other.

Passing through half sphere 50 from motor 82 is exhaust 83.

As set forth in FIG. 6 a pneumatic motor 82 is employed to drive the vibrator mechanism 84. Pneumatic, hydraulic or electric motors may be employed to drive the vibrator mechanism 84. The advantage of pneumatic and hydraulic motors is that they preclude the danger of electric sparks which may cause a fire, etc., within the bin. All motors 82 are designed to be reversible thereby giving the pronged sphere vibrator 46 the capability to control the direction of the sinosoidal wave when lifting or pushing the compacted material. All motors 82 are also capable of being adjusted to varying revolutions per minute.

The motor 82 drives motor shaft 86 which is housed within motor plate 88. The motor shaft 86 drives the coupling cup 90. The coupling cup 90 is secured to the shaft 86 in order that every revolution of the shaft 86 produces a revolution of the cup 90. Within the cup 90 are four pegs 91. The pegs 91 are capable of placement within the coupling disc 92. The coupling disc 92 is made of material such as polyurethane which aids in absorbing vibrational and sudden torque forces.

Figure 8:
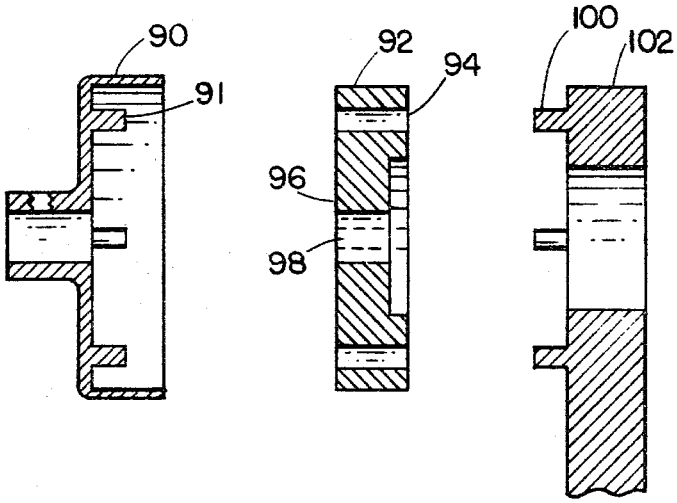
FIG. 8 is a side view of the coupling cup, coupling disc, and eccentric about to be joined.
Figure 9:
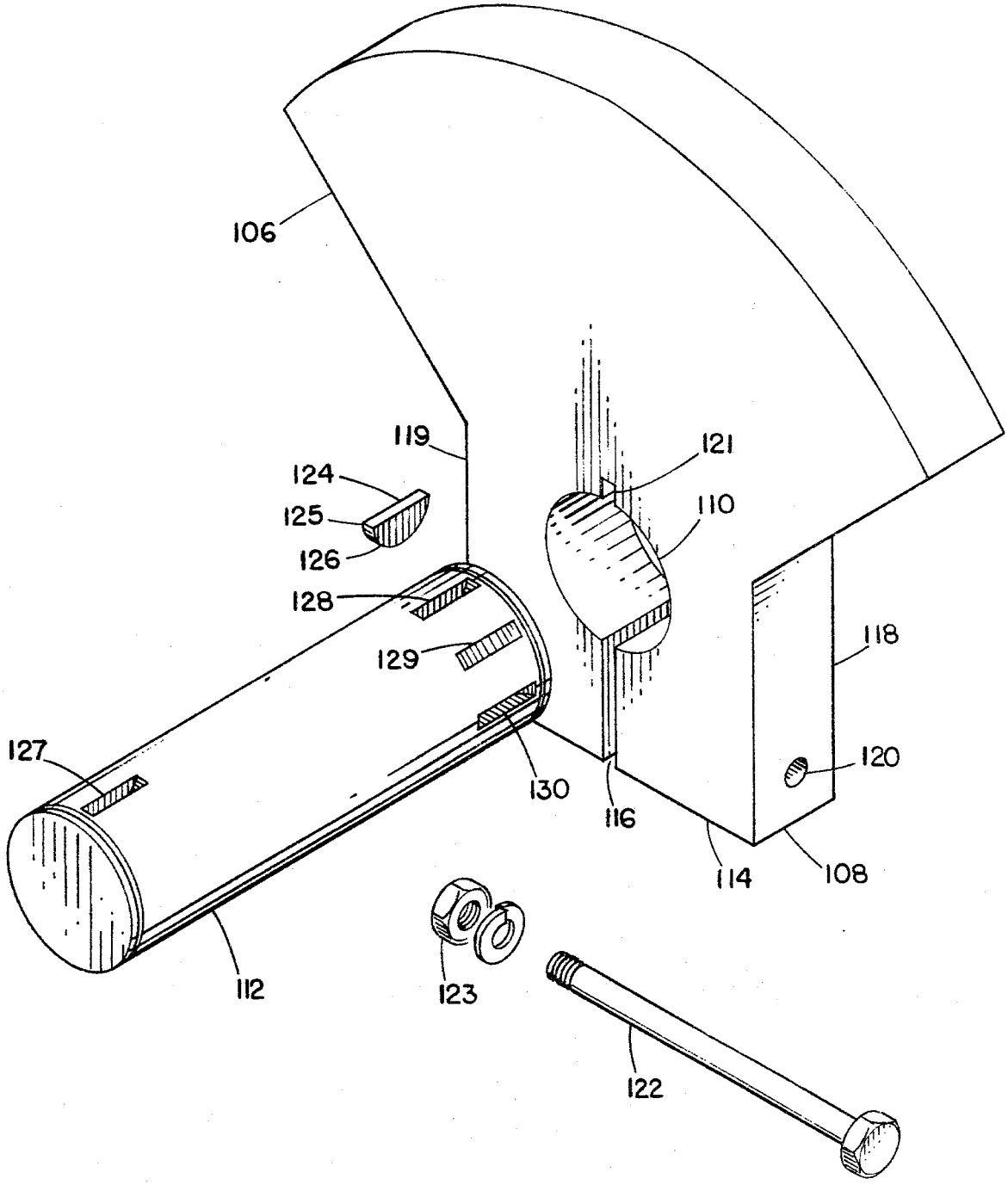
FIG. 9 is a side view of an eccentric about to be secured in one of three positions on the eccentric shaft by use of the key.

As set forth in FIG. 8, holes 94 are placed about the circumference of the coupling disc 92. Holes 94 run through the entire width of coupling disc 92. The motor shaft 86 abuts the face 96 of the coupling disc 92 at the indentations 98 in the face 94. The coupling disc is driven by four pegs 91 extending from the coupling cup 90 which is rotated by motor shaft 86. Pegs 91 extend into less than one-half of the width of the coupling cup.

Since both eccentric pegs 100 and pegs 91 within the coupling cup 90 are less than one-half the width of the coupling disc 92, if the disc 92 should disintegrate, both sets of pegs 100 and 91 would rotate without striking one another.

As set forth in FIG. 8 four pegs 100 extending from eccentric 102 are placed into the circumferential holes 94 of the coupling disc 92. The eccentric pegs 100 also extend into less than one-half of the width of the coupling disc 92. The eccentric pegs 100 interface opposite the pegs 91 within the coupling cups 90. Thus as the coupling cup 90 is caused to rotate, eccentric 102 rotates at the same speed.

Eccentrics 102 and 104 are fan shaped at their base 106. In the upper portion 108 of the eccentrics 102 and 104 a shaft hole 110 is placed in order to allow the entrance of the eccentric shaft 112. Extending from the shaft hole 110 to the top 114 of eccentrics 102 and 104 is slit 116. Running from side 118 of the upper portion 108 of the eccentrics 102 and 104 to opposing side 119 is hole 120 which allows bolt 122 and nut 123 to slightly collapse slit 116 and thereby tighten the upper portions 108 of the eccentrics 102 and 104 about the eccentric shaft 112.

Groove 121 runs below shaft hole 110 of both sufficient width and depth to accommodate the base 124 of key 125. The securing of the eccentric shaft 112 to eccentrics 102 and 104 is primarily achieved by the placement of the keys 125 within indentations which in the preferred embodiment are machined key ways in the shaft 112. Machined key way 127 is placed towards the end of the eccentric shaft 112 which abuts eccentric 102. Assembly is accomplished by inserting the semicircular portion 126 of key 125 into keyway 127 of shaft 112, then the eccentric 102 is slid onto the shaft 112 so that groove 121 aligns and traps the key 125. Machined key way 127 is congruent to the semi-circular configuration of the key. Thus, the rotation of the eccentric 102 drives eccentric shaft 112 at the same rate of revolutions per minute.

Eccentric 104 is attached to eccentric shaft 112 in the same manner as eccentric 102. However, at this end of the eccentric shaft 112 three machined key ways 128, 129 and 130 are placed in the eccentric shaft 112. Machined key way 128 is placed directed down the shaft 112 from machined key way 124. Thus when eccentrics 102 and 104 are secured in machined key ways 124 and 128 the eccentrics 102 and 104 are in perfect alignment. Machined key ways 120 and 130 are parallel to machined key way 128 and are aligned close to each other. However, when eccentric 104 is secured to either machined key way 120 or machined key way 130 eccentrics 102 and 104 are out of alignment, machined key way 130 causing the greatest amount of mis-alignment.

The varying machined key ways 128, 129 and 130 allow the operator to adjust the pounds of force of the vibrator by adjusting the relative positions of the eccentrics 102 and 104. This step enables the operator to take one of the three adjustments which achieves the imparting of the necessary frequency and amplitude to the compacted material.

Surrounding eccentric shaft 112 is bearing 132 which abuts eccentric shaft 112 and is housed within the vibrator case cylinder 134, vibrator case cylinder 134 being secured to the vibrator case 136. Bearing 132 abuts indentical bearing 133 which is similarly housed within the vibrator case cylinder 134. Vibrator bearing 132 abuts eccentric 102 and vibrator bearing 133 abuts eccentric 104. Eccentric 104 abuts back cover 138 which is secured to the vibrator case 136. Thus, the vibrator case 136 with the securing of the motor plate 88 and back cover 138 to the vibrator case 136, constitutes a complete housing for the vibrator mechanism 84. In the preferred embodiment the vibrator mechanism 84 are 100% fabricated and not molded.

Figure 10:
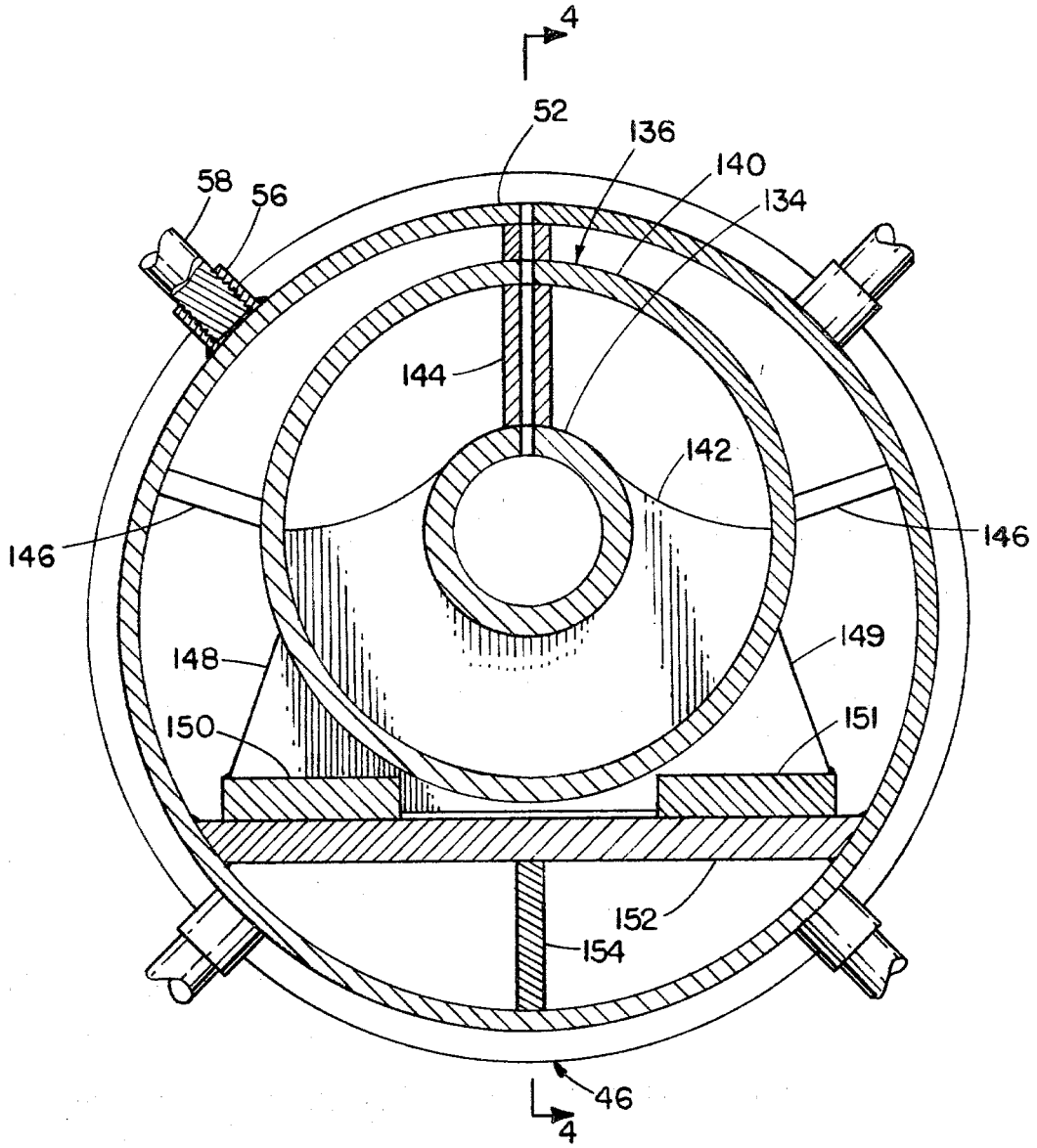
FIG. 10 is a sectional side view taken along lines 10—10 of the vibrator housed within the cylindrical outer shell.

The vibrator case shell 140 surrounds vibrator case cylinder 134 as illustrated in FIG. 10. The vibrator case cylinder is kept in position within the vibrator case shell 140 by cylinder hub support wall 142. Cylinder hub support wall 142 surrounds approximately two-thirds of the vibrator case cylinder 134. The cylinder hub support wall 142 is secured to the inner side of the vibrator case shell 140.

A hollow rod 144 runs from the pronged sphere cylinder 52 through the vibrator case shell 140 and through the vibrator case cylinder 134 to the bearings 132 and 133. Hollow rod 144 is capable of supplying grease or oil to bearings 132 and 133.

The vibration mechanism 84 is variously secured to the outer circumference of the pronged sphere vibrator 46. The vibration mechanism is adequately secured to the circumference of the pronged sphere vibrator to transmit vibrational energy to the compacted material.

The vibrator case 136 is positioned and secured to the pronged sphere cylinder 52 by rods 146. Attached to the lower portion of the vibrator case shell 140 are flanges 148 and 149. Flanges 148 and 149 are attached to vibrator case feet 150 and 151. Vibrator case feet 150 and 151 are secured to platform 152. Platform 152 is attached directly to the pronged sphere cylinder 52. In addition, guessett 154 is attached to the pronged sphere cylinder 52 and the under side of platform 52. Through the various securing aspects the rotating eccentrics impart their vibrational energy to the outer circumference of the pronged sphere vibrator 46 and prongs 58.

The pronged sphere vibrator 46 may be used individually or in tandem as illustrated in FIG. 1. When two pronged sphere vibrators 46 reach the compacted materials frequency, the material experiences a rippling effect and is even more effectively broken up than where one pronged sphere vibrator 46 is utilized.

Although a particular preferred embodiment of the invention has been disclosed above for illustrative purposes, it will be understood that variations or modifications thereof which lie within the scope of the appended claims are contemplated.

I claim:

1. A device for the vibration and breakup of compacted materials in storage structures such as grain elevators comprising:

(a) two separate half spheres in the shape of domes attached to either side of a cylindrical shell;
(b) prongs attached to the two separate half spheres and the cylindrical shell in a pattern such that the prongs are equidistant from one another;
(c) means for lowering, raising or locating the shell and attached prongs; and
(d) a means for vibrating the shell and attached prongs.

2. The device for vibration according to claim 1 wherein the means for vibrating the spherical shell and attached prongs comprises:

(a) a motor;
(b) two eccentrics;
(c) a circular disc;
(d) a means for driving the circular disc by the motor;
(e) a means for attaching the circular disc to one eccentric;
(f) a shaft which drives the eccentrics;
(g) a means for securing the shaft to the eccentric;
(h) a second eccentric;
(i) a means for attaching the shaft to the second eccentric;
(j) a vibrator case;
(k) a means for attaching the shaft which drives the eccentrics to the vibrator case; and
(l) a means for attaching the vibrator case to the spherical shell.

3. The device for vibration according to claim 2 wherein the means for driving the circular disc by the motor comprises:

(a) a shaft driven by the motor;
(b) a means for affixing said shaft to a cup which surrounds one side of the disc and surrounds the outer circumference of the disc; and
(c) a multiple of pegs affixed to the cup which fit in a multiple of holes around the circumference of the circular disc.

4. The device for vibration according to claim 3 wherein the means for attaching the coupling disc to the one eccentric comprises:

(a) a circular disc with a multiple of holes around the circumference of the circular disc;
(b) a multiple of pegs affixed to the eccentric which fit in the multiple of holes around the circumference of the circular disc.

5. The device for vibration according to claim 4 wherein the means for securing the shaft to the eccentric comprises:

(a) a groove which runs below the hole which houses the shaft which rotates the eccentrics;
(b) indentations in the shaft;
(c) semi-circular key with a straight base whose base fits in the groove and whose semi-circular portion above the base fits within the indentations of the shaft.

6. The device for vibration according to claim 5 wherein the means for attaching the shaft to the second eccentric comprises:

(a) a groove which runs below the hole which houses the shaft;
(b) three indentions in the shaft;
(c) a semi-circular key with a straight base whose base fits in the groove and whose semi-circular portion above the base fits within the indention of the shaft.

7. The device for vibration according to claim 6 wherein the means for attaching the eccentric shaft to the vibrator case comprises:

(a) a cylinder within the vibrator case;
(b) bearings attached within said cylinder; and
(c) the shaft which drives the eccentrics placed within the bearings.

8. the device for vibration according to claim 7 wherein the means for attaching the vibrator case to the spherical shell comprises:

(a) spacers which attach to the spherical shell and attach to the vibrator case;
(b) feet which attach to the vibrator case;
(c) gussets which attach to the vibrator case and the vibrator case feet;
(d) a platform which is attached to the cylinderical of the pronged sphere vibrator;
(e) a means for attaching the vibrator case feet to the platform.

9. The device for vibration of claim 1 wherein the radius of each of the two separate half spheres are identical, and the radius of the two separate half spheres is equal to or greater than the width of the cylindrical shell.

10. The device for vibration according to claim 9 wherein the pattern of fittings and prongs comprises:

(a) fourteen fittings positioned as follows: five fittings positioned about one of the half spheres, five fittings positioned about the remaining half sphere, four fittings positioned about the cylindrical shell wherein each of the fourteen fittings are equidistant from the fittings immediately adjacent; and
(b) fourteen prongs of equal length each prong being affixed to one of the fittings.

11. A device for the vibration and breakup of compacted materials in storage structures such as grain elevators comprising:

(a) a spherical shell;
(b) prongs attached to the spherical shell;
(c) a means for lowering, raising, or locating the spherical shell within the storage structure, the lowering, raising, or locating means comprising a cable;
(d) means for vibrating the spherical shell and attached prongs;
(e) an isolator located between the spherical shell and the cable to prevent the passage of vibrational energy to the cable, the isolator including first and second platforms, a sheet of vibration absorbing material stretched between the platform, means for attaching the sheet of material to the platforms, means for attaching one of the platforms to the cable and means for attaching the other of the platforms to the spherical shell.

12. A device for the vibration and breakup of compacted materials in storage structures such as grain elevators comprising:

(a) a rectangular shell;
(b) prongs attached to the rectangular shell;
(c) a means for vibrating the rectangular shell and attached prongs;
(d) a motor;
(e) two eccentrics;
(f) a circular disc with a multiple of holes around the circumference of the circular disc;
(g) a shaft driven by the motor;
(h) a means for affixing said shaft to a cup which surrounds one side of the circular disc and surrounds the outer circumference of the circular disc;
(i) a multiple of pegs affixed to the cup which fit in a multiple of holes around the circumference of the circular disc;
(j) a means for attaching the circular disc to one eccentric;
(k) a means for securing a shaft to the eccentric;
(l) a means for attaching the shaft to the second eccentric;
(m) a vibrator case;
(n) a means for attaching the shaft which drives the eccentrics to the vibrator case; and
(o) a means for attaching the vibrator case to the rectangular shell.

13. A device for the vibration and breakup of compacted materials in storage structures such as grain elevators comprising:

(a) a spherical shell;
(b) prongs attached to the spherical shell;
(c) a means for lowering, raising, or locating the spherical shell within the storage structure;
(d) a motor;
(e) two eccentrics;
(f) a circular disc;
(g) a means for driving the circular disc by the motor;
(h) a means for attaching the circular disc to a first eccentric;
(i) a shaft which drives the eccentrics;
(j) a means for securing the shaft to the first eccentric;
(k) a means for attaching the shaft to the second eccentric; and
(l) a means for transmitting vibratory energy produced by the two eccentrics to the spherical shell.

14. The device for vibration according to claim 13 wherein the means for transmitting vibratory energy produced by the two eccentrics to the spherical shell comprises:

(a) a vibrator case;
(b) a means for transmitting vibratory energy from the shaft which drives the eccentrics to the vibrator case; and
(c) a means for attaching the vibrator case to the spherical shell wherein vibratory energy is transmitted from the vibrator case to the spherical shell.

15. A device for the vibration and breakup of compacted materials in storage structures such as grain elevators comprising:

(a) a housing capable of vibration;
(b) prongs attached to the housing;
(c) a means for lowering, raising or locating the housing within the storage structure;
(d) a motor;
(e) two eccentrics;
(f) a circular disc;
(g) a means for driving the circular disc by the motor;
(h) a means for attaching the circular disc to a first eccentric;
(i) a shaft which drives the eccentrics;
(j) a means for securing the shaft to the first eccentric;
(k) a means for attaching the shaft to the second eccentric; and
(l) a means for transmitting vibratory energy produced by the two eccentrics to the housing.

16. A device for the vibration and breakup of compacted materials in storage containers such as grain elevators, said device comprising:

a body that includes a cylindrical shell extending along a cylinder axis and dome-like half-spheres secured to each end of said cylindrical shell;
a plurality of prongs attached to one end thereof to said body and extending outwardly therefrom;
means within said body and connected thereto for vibrating said body and attached prongs, said means including a rotatably mounted shaft and at least two eccentrically mounted weights secured to said shaft and axially spaced from one another, and;

means for adjusting the angular alignment of said eccentric weights on said shaft relative to one another to change the vibration characteristics of said vibration means.

17. The device claimed in claim 16 wherein said prongs are detachably attached at said one end to said body.

18. The device claimed in claim 17 wherein said detachable attachment is effected by a threaded connection between one end of said prongs and said body.

19. The device claimed in claim 16 wherein the length of the prongs is selected to aid in emitting a frequency substantially equal to the natural frequency of the compacted material.

20. The device claimed in claim 16 wherein the radius dimension of said half-spheres is substantially equal to one another and to the radius dimension of said cylindrical shell.

* * * * *